US008397623B2

(12) United States Patent
Herring

(10) Patent No.: US 8,397,623 B2
(45) Date of Patent: Mar. 19, 2013

(54) RIFLE AND KIT FOR CONSTRUCTING SAME

(76) Inventor: Geoffrey A. Herring, Melbourne, FL (US)

( * ) Notice: Subject to any disclaimer, the term of this patent is extended or adjusted under 35 U.S.C. 154(b) by 632 days.

(21) Appl. No.: 12/319,952

(22) Filed: Jan. 14, 2009

(65) Prior Publication Data

US 2013/0014417 A1 Jan. 17, 2013

(51) Int. Cl.
*F41A 3/82* (2006.01)

(52) U.S. Cl. ..... 89/199; 42/16; 42/75.03

(58) Field of Classification Search ..... 42/14, 16, 42/75.01, 75.03; 89/198, 199
See application file for complete search history.

(56) References Cited

U.S. PATENT DOCUMENTS

| | | | | | |
|---|---|---|---|---|---|
| 447,836 | A | | 3/1891 | Maxim | |
| 659,786 | A | | 10/1900 | Browning | |
| 689,283 | A | | 12/1901 | Browning | |
| 710,094 | A | | 9/1902 | Browning | |
| 874,856 | A | | 12/1907 | Mason | |
| 1,004,424 | A | | 9/1911 | Hennick | |
| 1,089,621 | A | * | 3/1914 | Barnes | 89/139 |
| 1,588,887 | A | * | 6/1926 | Haubroe | 42/75.03 |
| 1,886,113 | A | | 11/1932 | Lutton | |
| 1,931,262 | A | | 10/1933 | Loomis | |
| 1,971,597 | A | | 8/1934 | Browning | |
| 2,094,156 | A | | 9/1937 | Johnson | |
| 2,108,648 | A | | 2/1938 | Browning | |
| 2,146,743 | A | | 2/1939 | Johnson | |
| 2,189,202 | A | | 2/1940 | Garland | |
| 2,341,869 | A | | 2/1944 | Johnson | |
| 2,389,095 | A | * | 11/1945 | Vesely | 89/129.01 |
| 2,418,946 | A | | 4/1947 | Loomis | |
| 2,570,772 | A | | 10/1951 | Crittendon | |
| 2,732,768 | A | * | 1/1956 | Browning | 89/182 |
| 2,780,145 | A | * | 2/1957 | Saive | 89/199 |
| 2,951,424 | A | | 9/1960 | Stoner | |
| 3,015,993 | A | | 1/1962 | Franchi | |
| 3,410,175 | A | | 11/1968 | Johnson | |
| 3,461,731 | A | * | 8/1969 | Lewis | 74/22 R |
| 4,004,496 | A | | 1/1977 | Snodgrass | |
| 5,279,202 | A | * | 1/1994 | Bellardi et al. | 89/198 |
| 7,131,228 | B2 | | 11/2006 | Hochstrate | |
| 7,162,824 | B1 | | 1/2007 | McCormick | |
| 7,293,385 | B2 | | 11/2007 | McCormick | |

OTHER PUBLICATIONS

Definition of "Semispherical". The American Heritage® Dictionary of the English Language, Fourth Edition copyright ©2000 by Houghton Mifflin Company. Updated in 2009. Published by Houghton Mifflin Company. All rights reserved.*

* cited by examiner

*Primary Examiner* — Gabriel Klein
(74) *Attorney, Agent, or Firm* — David O. Simmons

(57) ABSTRACT

A rifle includes an upper receiver body, a lower receiver body detachably attached to the upper receiver body, a stock and a bolt carrier group. The upper receiver body has a bolt carrier receiving bore exposed at a stock engaging portion thereof. The stock includes a recoil spring receiving bore therein exposed at a mounting portion thereof. The mounting portion of the stock is engaged with the stock engaging portion of the lower receiver body in a manner whereby the recoil spring receiving bore is accessible from the bolt carrier receiving bore. A centerline axis of the recoil spring receiving bore is skewed with respect to a centerline axis of the bolt carrier receiving bore. The bolt carrier group has a bolt carrying structure slideably disposed within the bolt carrier receiving bore, a recoil spring engaging structure slideably disposed within the recoil spring receiving bore and a linkage member structure pivotably engaged between the bolt carrying structure and the recoil spring engaging structure.

18 Claims, 5 Drawing Sheets

RIFLE AND KIT FOR CONSTRUCTING SAME

FIELD OF THE DISCLOSURE

The disclosures made herein relate generally to firearms and, more particularly, to modular rifles specifically derived from assault rifles and configured for sporting and patrol type activities and uses. Such rifles are referred to herein as modular non-assault rifles.

BACKGROUND

Many firearms that are commonly used in military situations are designed by their manufacturer to be particularly suitable for military or combat purposes. These rifles are often referred to as "assault rifles". The AR-15 family of firearms, including the M16-type firearms, illustrates examples of assault rifles that are designed by their manufacturer to be particularly suitable for military or combat assault purposes. M16-type firearms are a military version of the AR-15 family of firearms capable of operating in a fully automatic mode. M16-type firearms have been manufactured by companies including, but not limited to Colt's Manufacturing Company, the ArmaLite Division of Fairchild Aircraft and Engine Company, Bushmaster Firearms Incorporated and Fabrique Nationale.

Sporting rifles, which are commonly used in sporting events such as hunting and match target shooting, are designed by their manufacturers to be particularly suitable for sporting purposes. The Ruger Mini-30, Ruger Ranch Rifle, Remington 742 and Browning BAR are examples of sporting rifles that are designed by their manufacturers to be particularly suitable for sporting purposes, which makes them particularly attractive for use in sporting activities and events. Furthermore, sporting rifles are typically designed to have attractive aesthetics such as fine wooden stocks and highly polished blued metal surfaces. While aesthetically pleasing, such aesthetic features do not hold up well to poor weather conditions and hard use.

Patrol rifles, which are commonly used in law enforcement situations, are designed by their manufacturers to be particularly suitable for law enforcement patrol purposes. The Remington 7615-P, Ruger Mini-14 GB, Ruger AC-556 and KEL-TEC SU-16 are examples of patrol rifles that are designed by their manufacturers to be particularly suitable for law enforcement patrol purposes, which make them particularly attractive for use by law enforcement personnel. Like sporting rifles, law enforcement patrol rifles are often manufactured with attractive aesthetics such as fine wooden stocks and highly polished blued metal surfaces. Accordingly, while aesthetically pleasing, such aesthetic features do not hold up well to poor weather conditions and hard use.

Shortcomings and drawbacks of traditional sporting rifles and patrol rifles include their fine metal finishes and attractive features. Other drawbacks of prior-art sporting rifles and patrol rifles are the frequent lack of availability and interchange ability of replacement components, as these components are often hand-fitted upon final assembly at the factory. Still a further drawback of prior-art sporting rifles and patrol rifles are the lack of accessories and upgrade components when compared to those of M16-type firearms.

In many cases, police armorers and manufacturers of military style assault rifles attempt to adapt such military-style assault rifles for law enforcement patrol purposes. Often, as manufactured military M16-type assault weapons are employed in the role of a civilian law enforcement patrol rifle.

In some instances, shooters and manufacturers of M16-style military assault rifles attempt to adapt them for sporting purposes. Examples of such adaptation include removing or modifying an element of the weapon (e.g., flash hider, bayonet lug, pistol grip), fitting the weapon with a thumb hole stock that mounts to a standard lower receiver body, pinning a telescoping stock in its open position, and/or pinning a magazine to the receiver body such that it is not detachable. Clearly, such approaches are limited in their effectiveness and/or usefulness.

As originally designed by their respective manufacturer(s), the AR-15, M16, M4, AR-10 and SR-25 firearms are collectively and generically referred to in the industry as "M16-type" firearms. M16-type firearms are typically auto loading and are usually either semi-automatic, full-automatic, burst-fire, selective-fire, or a combination of the above. Because of features such as automatic operation, pistol grip, flash hider, 30-round detachable magazine, bayonet lug and telescoping stock, M16-type firearms are considered by some to be particularly suitable for military missions and combat assault purposes. Conversely, they are not well suited and/or well received for the role as a rifle for sporting or patrol activities, largely due to their appearance being intimidating to some people.

M16-type firearms have been the primary service weapons of the US Armed. Forces and many of its allies around the world for more than forty years. Accordingly, many sportsmen and law enforcement personnel have been trained with M16-type firearms while serving in the military. M16-type firearms have become very popular with both returning servicemen from the Vietnam era and more recent wars as well as with civilian collector and shooting enthusiasts. M16-type firearms are manufactured for hard combat use in all-weather conditions. Accordingly, plastics and lightweight alloy metals are used in place of wood and steel for durability and lighter weight. Steel surfaces are usually phosphate finished instead of fine blued, and alloy (e.g., aluminium) surfaces are finished with hard coat non-reflective anodizing. As lives are at stake in military combat situations, the reliability and durability of combat weapons such as M16-type firearms is much greater than that of traditional both sporting and patrol rifles. Additionally, the duty cycles of internal components will in many cases far surpass those of traditional sporting and patrol rifles.

Many companies that manufacture M16-type firearms often seek to expand their market share by offering a semi-automatic only version of their M16-type firearms (i.e., generically as AR-15 type firearms). Most of the components of an M16-type firearm are interchangeable with those of an AR-15 type firearm, with the usual exceptions being the bolt carrier and fire control components that distinguish one from being semi-automatic and the other from being full-automatic. Because AR-15/M16-type firearms are manufactured in great quantities for supply to the US Military and its allies, replacement components and spare parts are rugged, interchangeable and manufactured in great quantities to support the logistics of repair in the field.

A very significant aftermarket industry has also evolved to support the demand for the popular AR-15/M16-type firearms and their respective myriad accessories for civilian, law-enforcement and military consumers. Examples of accessories are items such as a bipod, flashlight, MIL-STD-1913 hand guard, grip-pod, optical device, sound or flash suppressor; threaded barrel, grenade launcher, flare launcher or other device which is adapted or may be adapted to modern military style assault weapons to enhance their field capability. While usually envisioned and marketed for military use, many of these same accessories would be very practical for sporting and law enforcement uses.

In recent decades, AR-15/M16-type firearms have come under political attack by politicians wishing to ban them from civilian ownership. Supporters of legislation to ban "assault weapons" often cite rampage shootings as the reason for their support of anti-gun laws and, in particular, bans against rifles considered to be assault weapons. Even though shooters in such rampage shooting are obviously mentally deranged and/or did not use an assault rifle to commit such crimes, legislation has been proposed or passed that either limits ownership or outright bans ownership of so-called "Semi-Automatic Assault Weapons". In all cases, the bans or proposed bans of a rifle fully or partially rely on a rifle's physical features to define what is considered a banned weapon. Examples of such physical features include, but are not limited to, pistol grip, flash hider, threaded barrel, collapsible stock, grenade launcher, high capacity feeding device, detachable magazine or a combination of features that makes the weapon "not particularly suitable for sporting purposes."

The first such ban is the 1934 National Firearms Act, which restricts the transfer and possession of machine guns and other firearms. The 1968 Gun Control Act restricts the importation of many foreign firearms and regulates the methods of sale and transfer of firearms. The 1986 Firearm Owners Protection Act restricts manufacture and ownership of full-automatic weapons. The 1989 Assault Weapon Importation Ban was signed into effect by President George H. Bush, followed by the Assault Weapon Ban of 1994 signed by President William Jefferson Clinton (i.e., the Clinton Ban), which is considered by many in the firearm industry to be the most restrictive gun control legislation passed to date. In 2004, the "Clinton Ban" expired after 10 years in force. A current Bill of Congress is HR 1022 and HR 1312 ($109^{th}$), which seeks to reinstate the "Clinton Ban", includes additional firearm restrictions. Regrettably, none of the aforementioned gun bans take into account the mental status of the criminal shooter, yet they rely solely on origin of manufacture, and physical features and appearances of a class of firearm.

When such a class of firearm is restricted in commerce because of its physical characteristics and appearance, both law enforcement personnel and law abiding civilian citizens are adversely affected by the ban and consequently, denied full ownership and use of a class of firearm that has proven to be reliable, durable and useful in all type of weather. Additionally, a significant industry that caters to military, law enforcement and responsible civilian shooters suffers economic hardship. In many cases, these businesses cannot survive and, when they go out of business, the US Military and its allies are then unable to purchase unique goods that can enhance a soldier's mission success and survivability in combat.

In support of the "Global War on Terrorism" brought about by the World Trade Center and Pentagon terrorist attacks of Sep. 11, 2001, police in the United States (US) have been deployed in a more ready state to meet what is considered an imminent terrorist threat. While such types of deployment are common in some foreign countries and parts of Europe, historically, US law enforcement personnel have not been positioned on the streets of the US while visibly armed with machine guns and assault rifles. Because this has not been a traditional scene in US culture, the sight of police officers armed with assault rifles and machine guns causes discomfort and concern with a large segment of US citizens that may feel that they now live in a type of "police state" or combat zone. It is the same physical features and appearances of assault rifles that are the subject of various "assault weapon" bans that cause citizens to be alarmed when law enforcement personnel are armed with such weapons on US streets, airports, train stations and marine ports.

Therefore, a modular sporting rifle and a modular patrol rifle that overcomes drawbacks, limitations and/or shortcomings associated with sporting rifles, patrol rifles and rifles considered to be assault weapons would be advantageous, desirable and useful.

SUMMARY OF THE DISCLOSURE

It is a principal objective of the present invention to Provide improved sporting and law enforcement patrol rifles (i.e., modular non-assault rifles), which will overcome deficiencies of known firearms of such type. To this end, embodiments of the present invention provide a modular non-assault rifle that combines the reliability and modularity of a modern modular military rifle with the practicality of an all-weather sporting rifle and that is particularly suitable for sporting purposes. Alternatively, such a modular non-assault rifle is provided that combines the reliability and modularity of a modern military rifle with the practicality of an all-weather patrol rifle and that is particularly suitable for law enforcement purposes. Importantly and advantageously, modular non-assault rifles in accordance with embodiments of the present invention have a more traditional sport rifle appearance. Specifically, such modular non-assault rifles do not have a pistol grip protruding conspicuously beneath the bore axis, but retains the modularity, all-weather utility and reliability of a modern military rifle.

Preferably, but not necessarily, receiver bodies of a modular non-assault rifle in accordance with embodiments of the present invention are separable into an upper receiver assembly including a lower receiver body and a lower receiver assembly including an upper receiver body. The upper receiver body is configured for receiving ammunition through the lower receiver assembly, and the lower receiver assembly is attached to the upper receiver body. A bolt carrier group is disposed and reciprocates within the upper receiver body. The lower receiver assembly includes a receiver body capable of receiving ammunition and is configured for having a trigger group and a stock mounted thereon.

Accordingly, in one embodiment of the present invention, a rifle comprises a receiver assembly, a stock and a bolt carrier group. The receiver assembly has a bolt carrier receiving bore exposed at a stock engaging portion thereof. The stock includes a recoil spring receiving bore therein exposed at a mounting portion thereof. The mounting portion of the stock is engaged with the stock engaging portion of the receiver assembly in a manner whereby the recoil spring receiving bore is accessible from the bolt carrier receiving bore. A centerline axis of the recoil spring receiving bore is skewed with respect to a centerline axis of the bolt carrier receiving bore. The bolt carrier group has a bolt carrying structure slideably disposed within the bolt carrier receiving bore, a recoil spring engaging structure slideably disposed within the recoil spring receiving bore and a linkage member structure pivotably engaged between the bolt carrying structure and the recoil spring engaging structure.

In another embodiment of the present invention, a rifle comprises an upper receiver body, a lower receiver body, a stock, an adapter, and a bolt carrier group. The upper receiver body has a bolt carrier receiving bore extending therein. The lower receiver body is mounted on the upper receiver body and has a trigger group mounted thereon. At least a portion of trigger group extends into the bolt carrier receiving bore for allowing a cartridge to be selectively fired. The stock includes a recoil spring receiving bore therein exposed at a mounting portion thereof. The adapter includes a receiver body engaging portion, a stock engaging portion and a passage extending therebetween. The receiver body engaging portion is engaged with a mating portion of a stock engaging portion of the upper receiver body and/or a mating portion of the lower receiver body. The stock engaging portion is engaged with a mating portion of the stock. The adapter passage is configured such that the recoil spring receiving bore is accessible from the bolt carrier receiving bore through the adapter passage. A centerline axis of the recoil spring receiving bore is skewed with respect to a centerline axis of the bolt carrier receiving bore. The bolt carrier group has a bolt carrying structure slideably disposed within the bolt carrier receiving bore, a recoil spring engaging structure slideably disposed within the recoil spring receiving bore and a linkage member structure pivotably engaged between the bolt carrying structure and the recoil spring engaging structure. The linkage member structure extends through the adapter passage.

In another embodiment of the present invention, a kit for retrofitting a stock on a rifle comprises a stock and a bolt carrier group. The stock has a receiver assembly engaging portion that is configured to engage a stock engaging portion of a receiver assembly of the rifle. The stock includes a recoil spring receiving bore therein exposed at the receiver assembly engaging portion. The receiver assembly engaging portion is configured such that the recoil spring receiving bore is accessible from a bolt carrier receiving bore exposed at the stock engaging portion of the receiver assembly when the stock is attached to the receiver assembly. A centerline axis of the recoil spring receiving bore and a centerline axis of the bolt carrier receiving bore are jointly configured such that the centerline axis of the recoil spring receiving bore is skewed with respect to the centerline axis of the bolt carrier receiving bore when the stock is attached to the receiver assembly. The bolt carrier group has a bolt carrying structure, a recoil spring engaging structure and a linkage member structure. The bolt carrying structure, the recoil spring engaging structure and the linkage member structure are jointly configured for allowing the linkage member structure to be pivotably engaged between the bolt carrying structure and the recoil spring engaging structure when the bolt carrying structure is slideable disposed within the bolt carrier receiving bore and the recoil spring engaging structure is slideably disposed within the recoil spring receiving bore.

In yet another embodiment, a kit configured for modifying or constructing a rifle comprises a linkage member assembly and a bolt carrier. The linkage member assembly includes a linkage attachment structure and a linkage member structure. The linkage attachment structure has spaced apart legs at a first end portion thereof. The spaced apart legs are each pivotably connected to the linkage attachment structure. The spaced apart legs jointly define a passage between said legs extending from the first end portion of the linkage member structure toward a second end portion of the linkage member structure. The bolt carrier has a linkage member structure engaging portion at an end portion thereof. The linkage member structure engaging portion is configured for having the linkage attachment structure fixedly connected thereto.

In one preferred embodiment, an upper receiver assembly of a modular non-assault rifle in accordance with the present invention is an OEM or aftermarket upper receiver assembly for an AR-15/M16/M4, AR-10, SR-25 or AR-18/AR-180 military rifle, or any such firearm whereby the upper and lower receiver bodies are separable in a manner similar to an AR-15/M16/M4, AR-10, SR-25 or AR-18/AR-180 type firearm. The lower receiver assembly receives ammunition for communicating it to the upper receiver assembly and it may have a traditional style of butt stock, similar to Remington Model 870 or 1100 style shotguns or other traditional sporting firearms, instead of a pistol grip protruding conspicuously beneath the bore axis, and a stock, the kind normally found on an M16-type military style assault rifle.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
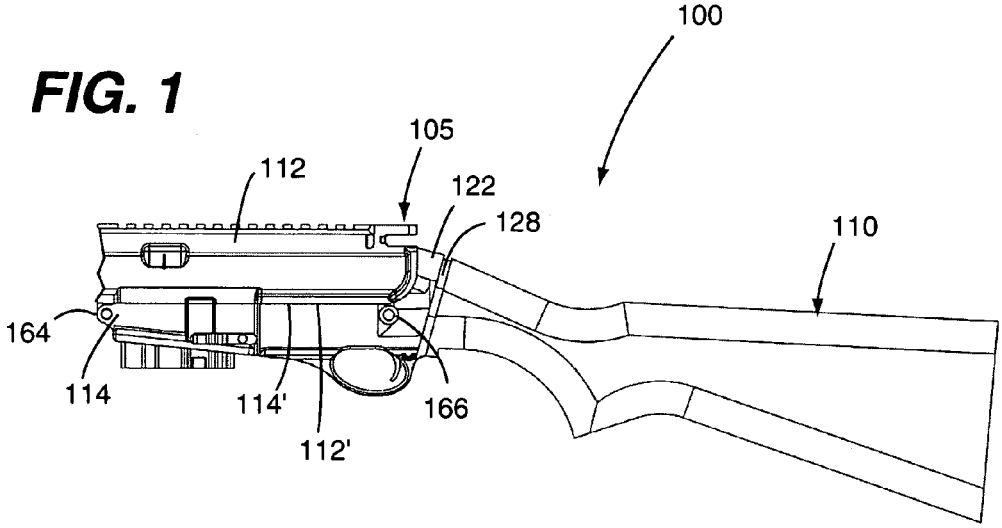
FIG. 1 is a side view showing a rifle in accordance with an embodiment of the present invention.
Figure 2:
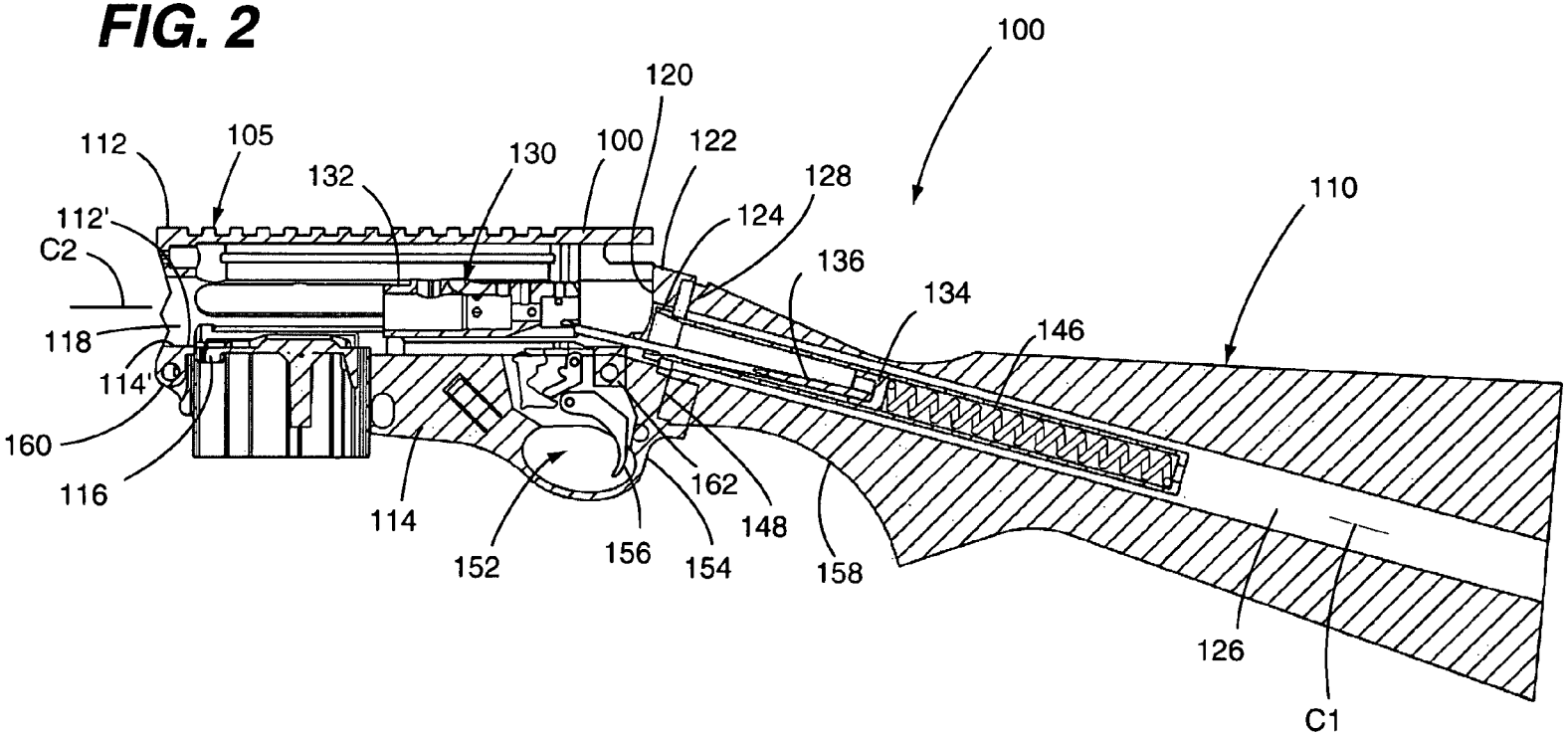
FIG. 2 is a cross sectional view of the rifle shown in FIG. 1.

Referring to FIGS. 1 and 2, a rifle 100 in accordance with an embodiment of the present invention is shown. The rifle 100 includes a receiver assembly 105 and a stock 110 attached to the receiver assembly 105. The receiver assembly 105 is configured in a manner consistent with a military-type assault rifle and the stock 110 is configured in a manner consistent with a sporting or patrol rifle. Accordingly, the rifle 100 is configured in a manner that provides for improved functionality in sporting and law enforcement applications as opposed to being optimally configured for military assault applications. The rifle 100 is, thus, a modular non-assault rifle that combines the reliability and modularity of a modern modular military rifle with the practicality of an all-weather rifle and that is particularly suitable for sporting and/or law enforcement patrol purposes.

Importantly and advantageously, as can be clearly seen in FIG. 1, use of a stock 110 that is configured in a manner consistent with a sporting or patrol rifle provides the rifle 100 with a traditional sport/patrol rifle appearance as opposed to that of a military-type assault rifle.

The receiver assembly 105 includes an upper receiver body 112 and a lower receiver body 114. The upper receiver body 112 is connected to the lower receiver body 114 in a manner allowing ammunition to be supplied through a magazine portion 116 of the lower receiver body 114 to the upper receiver body 112. The upper receiver body 112 has a bolt carrier receiving bore 118 extending therethrough. The bolt carrier receiving bore 118 is exposed at a rear face 120 (i.e., a stock engaging portion) of the upper receiver body 112. In a preferred embodiment, the upper receiver body is that of an M16-type firearm.

Generally, M16-type firearms are gas-operated via a gas block that is mounted to the barrel, a gas tube that communicates forces for automatically cycling the action and a bolt carrier that is designed to reciprocate in the upper receiver body. Upon firing a cartridge, the projectile in the weapon's bore passes a gas port in the barrel, and some of the hot expanding gasses that are propelling the projectile escape into the gas port. These expanding gasses and resulting pressure are in turn transmitted to the bolt carrier and bolt arrangement, which bias them into a recoil position. Upon reaching full recoil, an action or recoil spring returns the bolt carrier in the counter-recoil direction toward its forward static position.

In some cases, M16-type firearms have replacement upper receiver assemblies that are "piston-operated" and which are generally either "long-stroke" or "short-stroke" pistons. In the case of a long-stroke system, a piston-operated weapon has a piston and operating rod that is connected to the bolt carrier. A piston is energized upon firing and propels the operating rod and bolt carrier in the recoil direction. The travel distance of a long-stroke piston and operating rod are usually equal to the overall travel distance of the bolt carrier. In the case of a short-stroke system as disclosed in U.S. Pat. No. 3,246,567, a piston is energized upon firing and propels an operating rod into contact with a portion of the bolt carrier to bias it in the recoil direction. In yet another case, M16-type firearms may be upgraded with a short-stroke piston assembly, as disclosed in co-pending U.S. Non-Provisional patent application having Ser. No. 11/700,319 entitled "Gas Piston Assembly and Bolt Carrier for Gas Powered Firearms".

M16-type firearms have historically utilized a recoil spring housed within a receiver extension tube that is attached to the lower receiver body, and which is approximately concentric and parallel to the firearm's bore axis. The purpose of the recoil spring is to return the reciprocating bolt carrier group to a static counter-recoil position within the upper receiver body. Some manufacturers have developed M16-type upper receiver assemblies that contain the recoil spring within the upper receiver assembly. The primary purpose of relocating the recoil spring in the following examples is to provide for an M16-type firearm with a side folding stock. In these cases, the OEM style bolt carrier is shortened to reduce the space required for cycling of the bolt carrier group. In one example, the recoil spring is housed within the upper receiver body itself, above the bolt carrier. In another example, which is manufactured by Olympic Arms, the recoil spring is contained in a tube disposed above the upper receiver body. In yet another example, the ZM Weapons LR-300 places the recoil spring above the barrel and within the forward hand guard.

In its original manufacturer configuration, a M-16 type rifle is configured for magazine feed capability only, as disclosed in U.S. Pat. No. 3,045,555. However, as disclosed in U.S. Pat. Nos. 6,634,274 and 6,681,677, the M16 rifle can be reconfigured for dual ammunition feed capability (i.e., magazine-fed ammunition and belt-fed ammunition).

Figure 3:
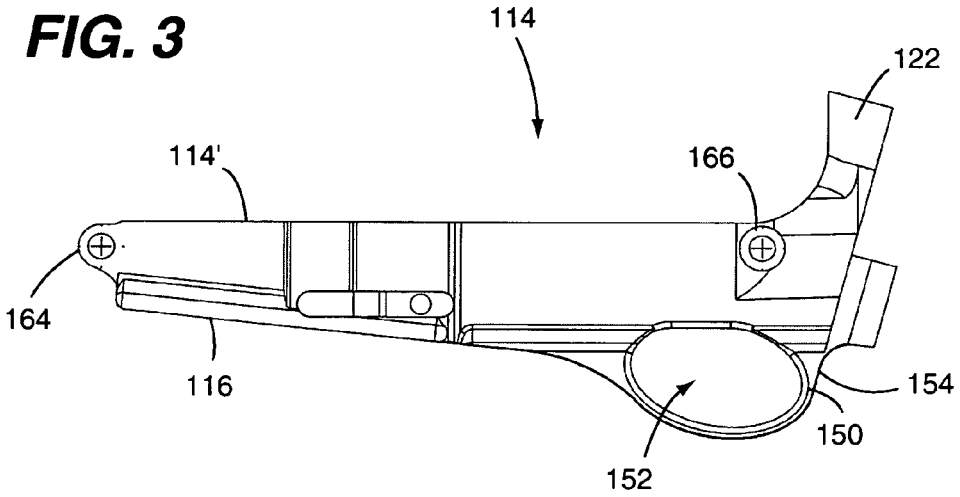
FIG. 3 is a side view showing a lower receiver body in accordance with an embodiment of the present invention.
Figure 4:
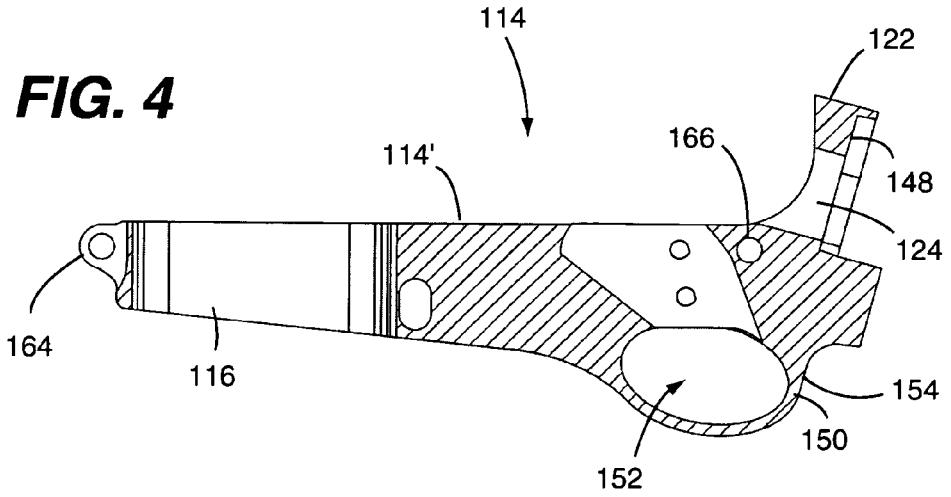
FIG. 4 is a cross sectional view of the lower receiver body shown in FIG. 3.

As best shown in FIGS. 2-4, the lower receiver body 114 includes a stock engaging portion 122 having a passage 124 extending therethrough. The stock engaging portion 122 extends vertically in front of the rear surface 120 of the upper receiver body 112. The lower receiver body passage 124 and the bolt carrier receiving bore 118 are jointly configured such that the bolt carrier receiving bore 118 is accessible through the lower receiver body passage 124.

The stock 110 includes a recoil spring receiving bore 126 exposed at a mounting portion 128 of the stock 110. The stock 110 is fixedly attached to the stock engaging portion 122 of the lower receiver body 114. The recoil spring receiving bore 126 and the mounting portion 128 are jointly configured such that the recoil spring receiving bore 126 is accessible from the bolt carrier receiving bore 118 when the stock 110 is attached to the lower receiver body 114. The stock and the stock engaging portion 122 of the lower receiver body 114 are jointly configured such that a centerline axis C1 of the recoil spring receiving bore 126 is skewed with respect to a centerline axis C2 of the bolt carrier receiving bore 118.

Figure 5:
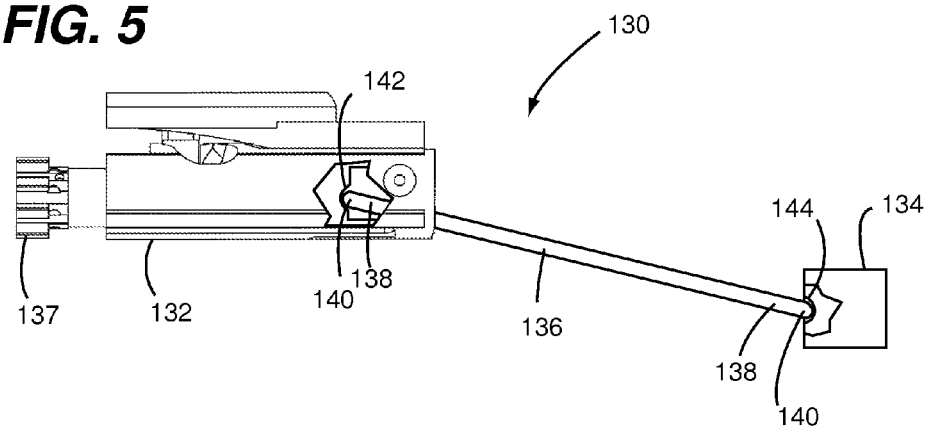
FIG. 5 is a partially cut-away side view showing a bolt carrier group in accordance with an embodiment of the present invention.

As shown in FIGS. 2 and 5, the rifle 100 includes a bolt carrier group 130 specifically configured to accommodate the skewed orientation of the recoil spring receiving bore 126 with respect to the bolt carrier receiving bore 118. The bolt carrier group 130 includes a bolt carrying structure 132, a recoil spring engaging structure 134, and a linkage member structure 136. A bolt 137 is rotatably mounted within a corresponding bore of the bolt carrying structure 132. The bolt carrying structure 132 is slideably disposed within the bolt carrier receiving bore 118. The recoil spring engaging structure 134 is slideably disposed within the recoil spring receiving bore 126. The linkage member structure 136 is pivotably engaged between the bolt carrying structure 132 and the recoil spring engaging structure 134, extending through the lower receiver body passage 124.

Preferably, but not necessarily, the linkage member structure 136 has a substantially straight longitudinal axis and opposing end portions 138 of the linkage member structure 136 include semi-spherical shaped tips 140. As shown in FIGS. 2 and 5, in preferred embodiments of the present invention, the semi-spherical shaped tips 140 are hemispherical in shape. The bolt carrying structure 132 includes a concave bearing surface 142 within an end portion thereof and has a first one of the linkage member structure tips 140 engaged with such concave bolt carrying structure bearing surface 142. In one embodiment, an original equipment bolt carrying structure for a rifle has a recoil spring engaging portion removed (e.g., cut and/or machined off) and a concave bearing surface provided (e.g., machined) therein. The recoil spring engaging structure 134 includes a concave bearing surface 144 within an end portion thereof and has a second one of the linkage member structure tips 140 engaged with such concave recoil spring engaging structure bearing surface 144. In this manner, the linkage member structure 136 is pivotably engaged with the bolt carrying structure 132 and the recoil spring engaging structure 134. It is disclosed herein that one or both of the ends of the linkage member structure 136 can be secured to the respective structure for precluding unintentional separation therefrom.

The rifle 100 includes a recoil spring 146 disposed within the recoil spring receiving bore 126. A first end portion of the recoil spring 146 is engaged with the recoil spring engaging structure 134 and a second end portion of the recoil spring 146 is constrained from moving in a direction away from the receiver assembly 105, such as via engagement with a static shoulder of the stock 110 or with a static should of a spring carrying sleeve within the stock 110. In this manner, sufficient translation of the bolt carrier structure 132 toward the stock 110 results in the linkage member structure 136 causing translation of the recoil spring engaging structure 134 a corresponding amount whereby the recoil spring 146 becomes at least partially compressed thereby generating stored energy for urging the recoil spring engaging structure 134 toward the receiver assembly 105. Through pivoting of the linkage member structure 136 with respect to the bolt carrying structure 132 and the recoil spring engaging structure 134, interaction between the bolt carrier group 130 and recoil spring 146 is facilitated even in view of the skewed orientation of the recoil spring receiving bore 126 with respect to the bolt carrier receiving bore 118.

In a preferred embodiment of the present invention, as shown in FIG. 2, a stock engaging surface 148 of the stock engaging portion 122 is substantially flat and extends substantially perpendicular to the longitudinal axis C1 of the recoil spring receiving bore 126. Additionally, a portion 150 of the lower receiver body 114 partially defines a trigger window 152 of the lower receiver body 114. The trigger window-defining portion 150 includes a surface 154 extending coincidental with the stock engaging surface 148 such that the trigger window 152 is immediately adjacent a rearmost portion of the lower receiver body 114. This rearward placement of the trigger window 152 is important in that it provides for proper relative placement of a trigger 156 with respect to a hand-gripping portion 158 of the stock 110.

Accordingly, in view of the foregoing disclosures, a skilled person will understand that embodiments of the present invention relate to a modular weapon system in which there is an upper receiver body and a lower receiver body that interconnects with the upper receiver body (i.e., a receiver body system). For example, as shown in FIGS. 1-4, the upper receiver body 112 (i.e., a first receiver body) and the lower receiver body 114 (i.e., a second receiver body) are jointly configured for being interconnected at respective mating interface surfaces (i.e., upper receiver interface surface 112' and lower receiver interface surface 114') and are interconnectable in a manner that enables interoperability between receiver components of the lower receiver body 114 and the upper receiver body 112. The upper receiver body 112 include interconnect structures 160, 162 and the lower receiver body 114 include interconnect structures 164, 166. Each one of the interconnect structures 160, 162 of the upper receiver body 112 is configured in size and position for being aligned with a respective one of the include and the interconnect structures 164, 166 of the lower receiver body 114 such that a suitable interconnect member can be engaged therewith for fixedly securing the upper receiver body 112 to the lower receiver body 114. In a preferred embodiment, the interconnect structures 160, 162 of the upper receiver body 112 and the interconnect structures 164, 166 of the lower receiver body 114 are each configured for receiving a pin (e.g., a slotted roll pin or detented takedown and pivot pin) therein.

Figure 6:
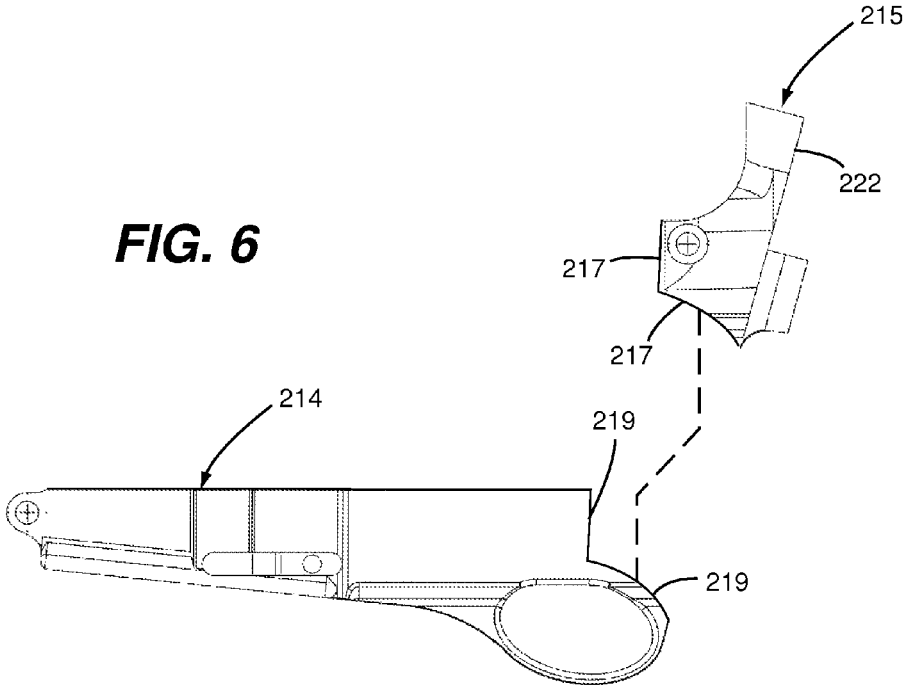
FIG. 6 shows a receiver body and mating adapter in accordance with an embodiment of the present invention.

Referring now to FIG. 6, a lower receiver body 214 and mating adapter 215 are shown. The adapter 215 includes an interface surface 217 (i.e., a receiver engaging portion) configured for being engaged with a mating interface surface 219 of the lower receiver body 214. The adapter 215 includes a stock engaging portion 222 and a passage (not shown, but the same in function as the passage 124 in FIG. 4). The passage extends through the stock engaging portion 222. With the adapter 215 fixedly attached to the lower receiver body 214, the lower receiver body 214 and the adapter 215 are functionally interchangeable with the lower receiver body 114 shown in FIGS. 1-4. Advantageously, the ability to separate the adapter 215 from the lower receiver body 214 allows different configurations of stocks to be attached to the lower receiver body 214. More specifically, the stock engaging portion 222 of the adapter 215 can be configured for engagement with a particular mounting portion of a stock. Accordingly, a single lower receiver body of a required configuration and a plurality of adapters can be used for allowing mounting stocks of a variety of different configurations using a single lower receiver body configuration.

In one embodiment of the present invention, a kit for retrofitting a stock on a rifle includes the lower receiver body 114 and the bolt carrier group 130 disclosed in reference to FIGS. 1 and 2. In another embodiment of the present invention, a kit for retrofitting a stock on a rifle includes the receiver body 214 and the adapter 215 disclosed in reference to FIG. 6 and the bolt carrier group disclosed in reference to FIGS. 1 and 2. Such kits each allow a stock of a particular sporting or patrol configuration to be used in conjunction with an upper receiver body of a firearm such as an assault rifle.

Figure 7:
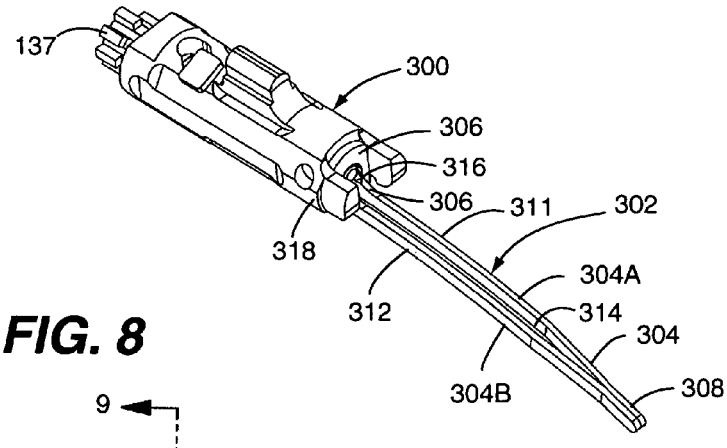
FIG. 7 is a perspective view showing a bolt carrier structure and mating linkage member assembly configured in accordance with an embodiment of the present invention.
Figure 8:
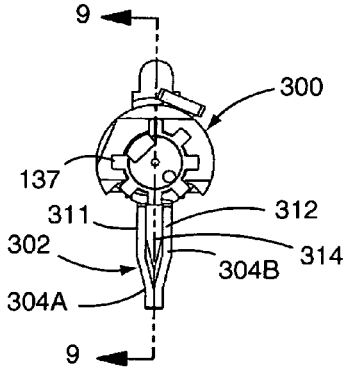
FIG. 8 is an end view of the bolt carrier structure and mating linkage member assembly shown in FIG. 7.
Figure 9:
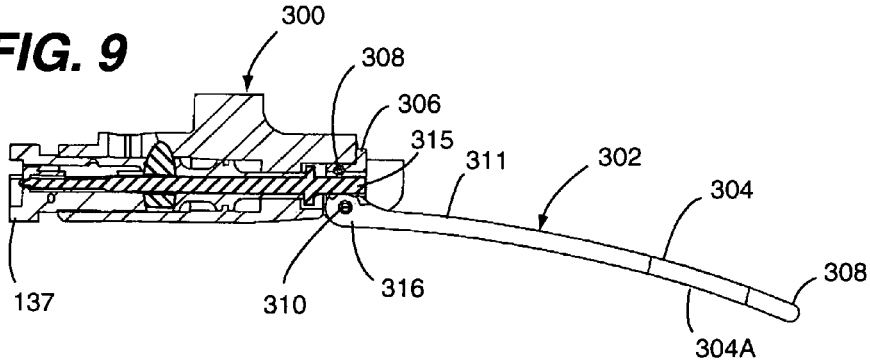
FIG. 9 is a cross-sectional view taken along the line 9-9 in FIG. 8.

FIGS. 7-9 disclose an embodiment of a bolt carrier structure 300 and a linkage member assembly 302 jointly configured in accordance with the present invention. It is disclosed herein that the bolt carrier structure 300, the linkage member assembly 302 or both can be part of a kit configured for constructing or modifying a firearm in accordance with the present invention. Such a kit can include all or a portion of the components comprising the linkage member assembly 302.

The bolt carrier 300 and the linkage member assembly 302 provide the same advantageous functionality as the bolt carrier structure 132 and the linkage member structure 136 shown in FIG. 5, which is recoil spring biasing when the recoil spring receiving bore of a firearm is skewed with respect to a centerline axis of the firearm's barrel. As will be discussed below in greater detail, advantageously, the linkage member assembly 302 includes a passage configured for having a hammer of a firearm disposed and displaced therein. With respect to bolt carrying functionality, the bolt carrier structure 300 receives and interacts with a bolt (e.g., the bolt 137) in identically or essentially the same manner as with the bolt carrier structure 132 shown in FIG. 5 receives and interacts with the bolt 137.

The linkage member assembly 302 includes a linkage member structure 304, a saddle 306, a carrier pin 308 and a linkage member pin 310. The linkage member structure 304 has a first end portion 306 and a second end portion 308 and has a non-linear profile (i.e., being arcuate, curved, etc) between its end portions 306, 308. The linkage member structure 304 includes spaced-apart legs 311, 312, which extend fully to the first end portion 306 and terminating together to define the second end portion 308. The spaced apart legs 311, 312 define a passage 314 therebetween. Accordingly, the passage 314 extends from the first end portion 306 to a central portion of the linkage member structure 304 (e.g., to where the second end portion 308 begins). As disclosed above, the passage 314 is configured for having a hammer of a firearm disposed and displaced therein (i.e., swings through the passage to impinge upon a firing pin 315).

As shown in FIGS. 7-9, the linkage member structure 304 includes two discrete linkage members 304A, 304B, which together form the linkage member structure 304. The linkage members 304A, 304B are curve in two planes so that the linkage member structure 304 is a non-linear profile (i.e., being arcuate, curved, etc) between its end portions 306, 308, so that the spaced apart legs 311, 312 define the passage 314 therebetween and so that the linkage members 304A, 304B abut at the second end portion 308 of the linkage member structure 304. It is disclosed herein that, in an alternate embodiment, a linkage member structure in accordance with the present invention can be a one-piece structure (e.g., machined or forged from a single piece of metal). Such a one-piece linkage member structure provides the same functionality and operability as the linkage member structure 304 shown in FIGS. 7-9.

At the first end portion of the linkage member structure 304, each one of the spaced apart legs 311, 312 includes a saddle engaging portion 316. The linkage member pin 310 extends through mating passages of the saddle 306 and the saddle engaging portion 316 of each spaced apart leg 311, 312 for pivotable securing the spaced apart legs 311, 312 to the saddle 306 in a manner allowing the spaced apart legs 311, 312 to freely pivot with respect to the saddle about a central axis of the linkage member pin 310. The second end portion 308 of the linkage member structure 304 is configured for being engaged with a recoil spring engaging structure. For example, the second end portion 308 of the linkage member structure 304 can be configured for being pivotably engaged with the recoil spring engaging structure 134.

The bolt carrier structure 300 includes a saddle engaging portion 318 (i.e., linkage member structure engaging portion) configured for having the saddle 306 (i.e., linkage attachment structure) mounted thereon. The saddle 306 is engaged with the saddle engaging portion 318 (e.g., partially received therein). The carrier pin 308 extends through mating passages of the saddle 306 and the saddle engaging portion 318 of the bolt carrier structure 300 for fixedly securing the saddle 306 to the bolt carrier structure 300.

It is disclosed herein that a modular sporting rifle or modular patrol rifle in accordance with an embodiment of the present invention can be one of a single shot, semi-automatic, burst-fire, full-automatic, select-fire, pump-action, bolt-action or a combination of these action types and modes of fire. Furthermore, such a modular sporting rifle or modular patrol rifle can be accessorized with items such as a bipod, flashlight, MIL-STD-1913 hand guard, grip-pod, optical device, sound or flash suppressor, threaded barrel, grenade launcher, flare launcher or other device which is adapted or may be adapted to modern military style assault weapons. It is disclosed herein that a modular sporting rifle or modular patrol rifle in accordance with an embodiment of the present invention is not unnecessarily limited to a specific type of style of rifle. However, in a preferred embodiment of the present invention, the upper receiver body and, optionally, the lower receiver assembly of such a modular sporting rifle or modular patrol rifle in accordance with an embodiment of the present invention will be that of a military style assault rifle (e.g., a M-16 type rifle).

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A rifle, comprising:

a receiver body system including an upper receiver body and a lower receiver body detachably attached to the upper receiver body, the upper receiver body having a bolt carrier receiving bore exposed at a portion thereof that engages a stock engaging portion of the lower receiver;

a stock including a recoil spring receiving bore therein exposed at a mounting portion thereof, wherein the mounting portion of the stock is engaged with a stock engaging portion of the lower receiver body in a manner whereby the recoil spring receiving bore is accessible from the bolt carrier receiving bore and wherein a centerline axis of the recoil spring receiving bore is skewed with respect to a centerline axis of the bolt carrier receiving bore; and a bolt carrier group having a bolt carrying structure slideably disposed within the bolt carrier receiving bore, a recoil spring engaging structure slideably disposed within the recoil spring receiving bore and a linkage member structure pivotably engaged between the bolt carrying structure and the recoil spring engaging structure, wherein a bolt of the bolt carrier group is rotatably mounted within a corresponding bore of the bolt carrying structure, wherein the bolt rotates about a centerline axis of the bolt carrier receiving bore, wherein the bolt carrying structure includes a concave bearing surface within an end portion thereof, wherein an end portion of the linkage member is engaged with the concave bearing surface, and wherein the concave bearing surface is vertically positioned at the centerline axis of the bolt carrier receiving bore.

2. The rifle of claim 1 wherein:

the linkage member structure has a substantially straight longitudinal axis;

opposing end portions of the linkage member structure include hemispherical shaped tips;

a first one of said linkage member structure tips is engaged with said bolt carrying structure bearing surface; and the recoil spring engaging structure includes a concave bearing surface within an end portion thereof and has a second one of said linkage member structure tips engaged with said recoil spring engaging structure bearing surface.

3. The rifle of claim 1 wherein:

the stock engaging portion is carried entirely by the lower receiver body;

the stock engaging portion includes a passage extending therethrough; the linkage member structure extends through the passage; and a stock engaging surface of the stock engaging portion is substantially flat, extends substantially perpendicular to a longitudinal axis of the recoil spring receiving bore, and terminates at a portion of the lower receiver defining a trigger window of the lower receiver.

4. The rifle of claim 3 wherein:

a portion of the lower receiver body partially defines a trigger window thereof; and said trigger window defining portion includes a surface extending coincidental with a stock engaging surface of the lower receiver such that the trigger window is immediately adjacent a rearmost portion of the lower receiver body.

5. The rifle of claim 1, further comprising:

a recoil spring disposed within the recoil spring receiving bore, wherein a first end portion of the recoil spring is engaged with the recoil spring engaging structure and a second end portion of the recoil spring is constrained from moving in a direction away from the upper receiver body such that sufficient translation of the bolt carrier structure toward the stock results in the linkage member structure causing translation of the recoil spring engaging structure a corresponding amount whereby the recoil spring becomes at least partially compressed thereby generating stored energy for urging the recoil spring engaging structure toward the upper receiver body.

6. The rifle of claim 5 wherein:

the linkage member structure has a substantially straight longitudinal axis;

opposing end portions of the linkage member structure include hemispherical shaped tips;

a first one of said linkage member structure tips is engaged with said bolt carrying structure bearing surface; and the recoil spring engaging structure includes a concave bearing surface within an end portion thereof and has a second one of said linkage member structure tips engaged with said recoil spring engaging structure bearing surface.

7. The rifle of claim 6 wherein:

the stock engaging portion is carried entirely by the lower receiver body;

the stock engaging portion includes a passage extending therethrough; and the linkage member structure extends through the passage.

8. A rifle, comprising:

an upper receiver body having a bolt carrier receiving bore extending therein;

a lower receiver body mounted on the upper receiver body, wherein the lower receiver body includes a trigger group mounted thereon and wherein at least a portion of trigger group extends into the bolt carrier receiving bore for allowing a cartridge to be selectively fired;

a stock including a recoil spring receiving bore therein exposed at a mounting portion thereof;

an adapter including a receiver body engaging portion, a stock engaging portion and a passage extending therebetween, wherein the receiver body engaging portion is engaged with a mating portion of at least one of a portion of the upper receiver that engages a stock engaging portion of the lower receiver and a mating portion of the lower receiver body, wherein the stock engaging portion is engaged with a mating portion of the stock, wherein said adapter passage is configured such that the recoil spring receiving bore is accessible from the bolt carrier receiving bore through said adapter passage and wherein a centerline axis of the recoil spring receiving bore is skewed with respect to a centerline axis of the bolt carrier receiving bore; and a bolt carrier group having a bolt carrying structure slideably disposed within the bolt carrier receiving bore, a recoil spring engaging structure slideably disposed within the recoil spring receiving bore and a linkage member structure pivotably engaged between the bolt carrying structure and the recoil spring engaging structure, wherein the linkage member structure extends through said adapter passage, wherein a bolt of the bolt carrier group is rotatably mounted within a corresponding bore of the bolt carrying structure, wherein the bolt rotates about a centerline axis of the bolt carrier receiving bore, wherein the bolt carrying structure includes a concave bearing surface within an end portion thereof, wherein an end portion of the linkage member is engaged with the concave bearing surface, and wherein the concave bearing surface is vertically positioned at the centerline axis of the bolt carrier receiving bore.

9. The rifle of claim 8 wherein:

opposing end portions of the linkage member structure include hemispherical shaped tips;

a first one of said linkage member structure tips is engaged with said bolt carrying structure bearing surface; and the recoil spring engaging structure includes a concave bearing surface within an end portion thereof and has a second one of said linkage member structure tips engaged with said recoil spring engaging structure bearing surface.

10. The rifle of claim 8 wherein:

a portion of the lower receiver body partially defines a trigger window thereof;

said trigger window defining portion includes a surface extending coincidental with a surface of the stock engaging portion such that the trigger window is immediately adjacent a rearmost portion of the lower receiver body.

11. The rifle of claim 10 wherein:

the linkage member structure has a substantially straight longitudinal axis;

opposing end portions of the linkage member structure include hemispherical shaped tips;

a first one of said linkage member structure tips is engaged with said bolt carrying structure bearing surface; and the recoil spring engaging structure includes a concave bearing surface within an end portion thereof and has a second one of said linkage member structure tips engaged with said recoil spring engaging structure bearing surface.

12. The rifle of claim 8, further comprising:

a recoil spring disposed within the recoil spring receiving bore, wherein a first end portion of the recoil spring is engaged with the recoil spring engaging structure and a second end portion of the recoil spring is constrained from moving in a direction away from the receiver assembly such that sufficient translation of the bolt carrier structure toward the stock results in the linkage member structure causing translation of the recoil spring engaging structure a corresponding amount whereby the recoil spring becomes at least partially compressed thereby generating stored energy for urging the recoil spring engaging structure toward the receiver assembly.

13. The rifle of claim 12 wherein:

the linkage member structure has a substantially straight longitudinal axis;

opposing end portions of the linkage member structure include hemispherical shaped tips;

a first one of said linkage member structure tips is engaged with said bolt carrying structure bearing surface; and the recoil spring engaging structure includes a concave bearing surface within an end portion thereof and has a second one of said linkage member structure tips engaged with said recoil spring engaging structure bearing surface.

14. A kit for retrofitting a stock on a rifle, wherein the stock having a receiver assembly engaging portion that is configured to engage a stock engaging portion of a receiver assembly of the rifle, wherein the stock includes a recoil spring receiving bore therein exposed at the receiver assembly engaging portion, wherein the receiver assembly engaging portion is configured such that the recoil spring receiving bore is accessible from a bolt carrier receiving bore exposed at the stock engaging portion of the receiver assembly when the stock is attached to the receiver assembly, and wherein a centerline axis of the recoil spring receiving bore and a centerline axis of the bolt carrier receiving bore are jointly configured such that the centerline axis of the recoil spring receiving bore is skewed with respect to the centerline axis of the bolt carrier receiving bore when the stock is attached to the receiver assembly, the kit comprising:

a bolt carrier group having a bolt carrying structure, a recoil spring engaging structure and a linkage member structure, wherein the bolt carrying structure, the recoil spring engaging structure and the linkage member structure are jointly configured for allowing the linkage member structure to be pivotably engaged between the bolt carrying structure and the recoil spring engaging structure when the bolt carrying structure is slideable disposed within the bolt carrier receiving bore and the recoil spring engaging structure is slideably disposed within the recoil spring receiving bore, wherein a bolt of the bolt carrier group is rotatably mounted within a corresponding bore of the bolt carrying structure of the bolt carrier group, wherein the bolt rotates about a centerline axis of the bolt carrier receiving bore, wherein the bolt carrying structure includes a concave bearing surface within an end portion thereof, wherein an end portion of the linkage member is engaged with the concave bearing surface, and wherein the concave bearing surface is vertically positioned at the centerline axis of the bolt carrier receiving bore.

15. The kit of claim 14 wherein:

the linkage member structure has a substantially straight longitudinal axis;

opposing end portions of the linkage member structure include hemispherical shaped tips;

a first one of said linkage member structure tips is engaged with said bolt carrying structure bearing surface; and the recoil spring engaging structure includes a concave bearing surface within an end portion thereof and has a second one of said linkage member structure tips engaged with said recoil spring engaging structure bearing surface.

16. The kit of claim 14, further comprising:

a lower receiver body including a portion thereof that partially defines a trigger window thereof, wherein the lower receiver body includes a stock engaging portion configured for having the receiver assembly engaging portion of the stock engaged therewith, wherein the stock engaging portion of the lower receiver body includes a passage extending therethrough for allowing the linkage member structure to extend therethrough and wherein said trigger window defining portion includes a surface extending coincidental with a stock engaging surface of the stock engaging portion such that the trigger window is immediately adjacent a rearmost portion of the lower receiver body.

17. The kit of claim 14, further comprising:

an adapter including a receiver body engaging portion, a stock engaging portion and a passage extending therebetween, wherein the receiver body engaging portion is configured for being engaged with a mating portion of the receiver assembly, wherein the stock engaging portion is configured for being engaged with the receiver body assembly engaging portion of the stock, wherein said adapter passage is configured such that the recoil spring receiving bore is accessible from the bolt carrier receiving bore through said adapter passage when the adapter is coupled between the receiver assembly and the stock and wherein a centerline axis of the recoil spring receiving bore is skewed with respect to a centerline axis of the bolt carrier receiving bore when the adapter is coupled between the receiver assembly and the stock.

18. The kit of claim 17 wherein:

the linkage member structure has a substantially straight longitudinal axis;

opposing end portions of the linkage member structure include hemispherical shaped tips;

a first one of said linkage member structure tips is engaged with said bolt carrying structure bearing surface; and the recoil spring engaging structure includes a concave bearing surface within an end portion thereof and has a second one of said linkage member structure tips engaged with said recoil spring engaging structure bearing surface.

* * * * *